US005180160A

United States Patent [19]

Belanger et al.

[11] Patent Number: 5,180,160

[45] Date of Patent: Jan. 19, 1993

[54] DELIVERY DEVICE IN THE FOLDING APPARATUS OF A ROTARY PRINTING PRESS

[75] Inventors: Roger R. Belanger, Dover; Richard B. Mack, Durham; Michael A. Novick, New Durham, all of N.H.

[73] Assignee: Heidelberg Harris GmbH, Heidelberg, Fed. Rep. of Germany

[21] Appl. No.: 743,994

[22] Filed: Aug. 12, 1991

[51] Int. Cl.[5] ..... B65H 29/20

[52] U.S. Cl. ..... 271/315; 271/187

[58] Field of Search ..... 271/315, 187, 66, 72, 271/83

[56] References Cited

U.S. PATENT DOCUMENTS 3,355,169 11/1967 Seyl ..... 271/187
4,522,387 6/1985 Leuthold .
4,915,371 4/1990 Quinton ..... 271/187
5,000,437 3/1991 Schneider et al. ..... 271/315

FOREIGN PATENT DOCUMENTS 3827701 3/1989 Fed. Rep. of Germany .
0051268 3/1988 Japan ..... 271/315
2168686 6/1986 United Kingdom ..... 271/315

*Primary Examiner*—H. Grant Skaggs
*Attorney, Agent, or Firm*—Herbert L. Lerner; Laurence A. Greenberg

[57] ABSTRACT

A delivery device in a folding apparatus of a printing press includes a fan wheel or several fan wheels disposed next to one another. The fan wheels are formed of individual fan blades, between which fan wheel pockets are formed. Leading edges of the fan blades have a first profile and trailing edges of the fan blades have a second profile.

12 Claims, 4 Drawing Sheets

DELIVERY DEVICE IN THE FOLDING APPARATUS OF A ROTARY PRINTING PRESS

Figure 1B:
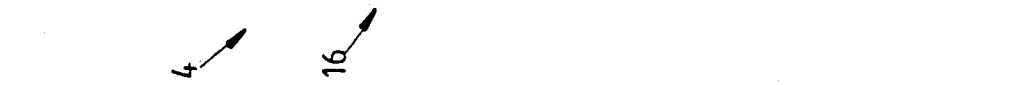

The invention relates to a delivery device in the folding apparatus of a rotary printing press.

In general, folded products which are being produced in a rotary printing press are slowed down by means of costly and complex slow down devices.

German Published, Non-Prosecuted Application DE 38 27 701 A1 discloses air-blowing nozzles which help to press the folded products onto fan-blade surfaces, in order to increase sliding friction and therefore increase the slow down process. U.S. Pat. No. 4,522,387 discloses a fan wheel configuration, which is embodied by a special configuration of several fan wheels being fastened onto a common shaft. The turning or rotational position of the individual fan wheels towards one another on the common shaft is different from one fan wheel to another. Moreover, spirally formed slots are mutually displaced in longitudinal fashion.

The disadvantage of such a structure can be seen in the fact that the objects being transported at high speed hit the bottom of the fan-pockets. With that structure, the leading ends of those transported items are severely deformed and possibly even scratched, which can lead to complaints from customers.

Furthermore, the handling of objects made of very thin and light paper is extremely complicated. If objects formed of several pages enter into the fan wheels, the formation of "dog ears", due to the severe bending in the fan wheel pockets, inevitably occurs on the folded products since the input regions are very narrowly dimensioned.

Moreover, the slowing down of the objects occurs only on one side of the slots, whereas the opposite side of the slots remains unused. Even then, due to a boundary layer of air surrounding to each folded product, kinetic energy dissipation (slow down) through friction is severely limited.

It is accordingly an object of the invention to provide a delivery device in the folding apparatus of a rotary printing press, which overcomes the hereinafore-mentioned disadvantages of the heretofore-known devices of this general type and which improves the delivery accuracy or exactness of folded products.

With the foregoing and other objects in view there is provided, in accordance with the invention, a delivery device in a folding apparatus of a printing press, comprising at least one fan wheel, the fan wheel being formed of individual fan blades defining fan wheel pockets between the fan blades for receiving incoming folded products, and each of the fan wheel pockets for an incoming folded product is defined by a trailing or back-positioned fan blade having a first profile of a leading edge relative to the incoming folded product, and a leading or front-positioned fan blade having a second profile of a trailing edge relative to the incoming folded product.

The enormous advantage of this invention lies in the fact that the folded products are slowed down by simple means, even at higher speeds, without the need for complex additional devices. A significantly higher dissipation of kinetic energy, i.e. a slow down, is achievable due to the deformation of the respective loading and trailing edges of the individual fan blades. Furthermore, it is essential that the product is forced, by means of an impact angle, to glance off with a bend being produced that transverses along the folded product length as the latter moves into the fan wheel pockets. The folded products experience careful treatment and are not slowed down abruptly in the fan wheel pocket, but rather in steps.

In accordance with another special feature of the invention, the profile of the fan blades at the trailing edge of a delay path or distance has a first concave recess and a second concave recess. The advantage of this feature is that a controlled deformation is impressed or embossed onto the folded products while moving past the fan wheel pockets. The slow down takes place in steps and a sudden impact of the folded products at the bottom of the fan pockets is thereby avoided.

In accordance with a further feature of the invention, the profiles of the fan blades at the leading edges have an impact path, distance or route, and the fan wheel pocket formed of the leading and trailing edges is bent in a bottom region of the fan wheel pocket, in the direction of a fan wheel hub. In this regard, it is advantageous that the impact path extends in one plane or on one level in relation to the output of the folded products from a transport tape system. This allows a first slow down of the folded products to be developed immediately upon input.

In accordance with an added feature of the invention, the fan wheel pockets are repeatedly bent and shaped in meander-form. The advantage of this shaping lies in an additionally attainable impacting of the folded product by alternating the leading or the trailing edges of the fan blades.

In accordance with an additional feature of the invention, the fan wheel pockets have an input region and a narrowing of the fan wheel pocket due to a discontinuously running contour at the trailing edge of a fan blade. In this way, the slow down takes place only when the folded product is completely absorbed or accepted by the fan wheel pocket.

In accordance with yet another feature of the invention, there is provided an angle being formed between the folded products entering into the fan wheel pocket, and the impact path of the leading edge of the fan blades, which ensures that the entering folded product securely runs into the fan wheel pocket and that no air cushion can form between the folded product and the impact path.

In accordance with yet a further feature of the invention, there is provided an angle between the end of the impact path and the folded product leaving the impact path. This causes the delayed folded product to be lead onto the trailing edge of the fan blade delimiting the fan wheel pocket, and therefore makes use of another slow down distance for an easy or soft slow down.

In accordance with yet an added feature of the invention, there is provided an angle included between the leading edge of the folded product and a delivery section of the first concave recess. In this way, the folded product is additionally being forcibly molded which decreases its kinetic energy.

In accordance with yet an additional feature of the invention, there is provided an angle between the leading edge of the folded product and a delivery section of the second concave recess. The advantage obtained through the use of this feature is that a further slow down of the folded product occurs while moving past the second concave recess, immediately before reaching the bottom of the fan pocket.

The effect of this slow down is additionally supported in such a way that the bending of the fan wheel pocket in this region is strongly emphasized and that a kinetic energy absorbing deformation or molding is impressed or embossed onto the folded product.

In accordance with again another feature of the invention, the fan wheel pockets are longer than the folded products and the entire length of a folded product enters the fan pocket. This insures a useable delay path or distance which is as long as possible.

In accordance with a concomitant feature of the invention, the leading edge in the vicinity of the impact path and the trailing edge in the vicinity of the delay path of the first concave recess and the second concave recess are formed of ink-repellent material.

Other features which are considered as characteristic for the invention are set forth in the appended claims.

Although the invention is illustrated and described herein as embodied in a delivery device in the folding apparatus of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1A:
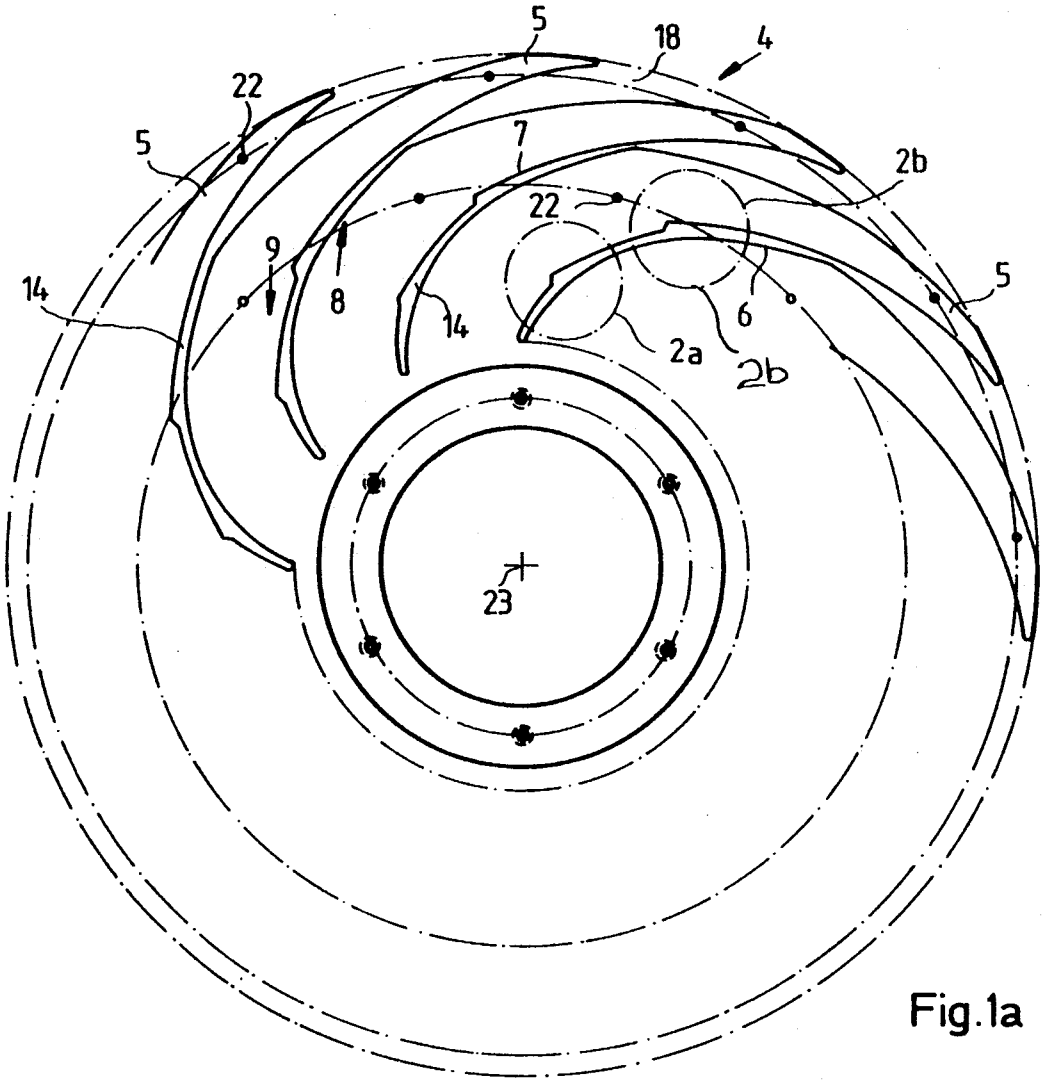
Figure 2A:
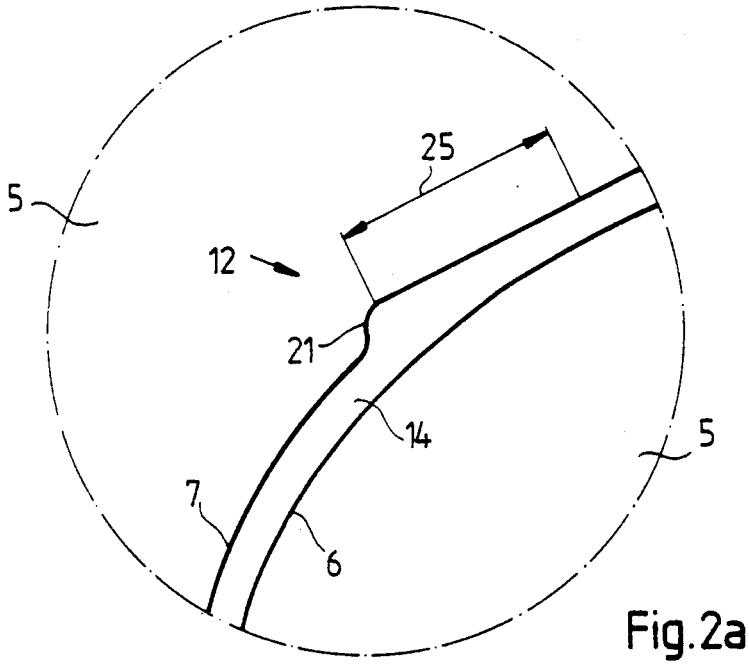
Figure 2B:
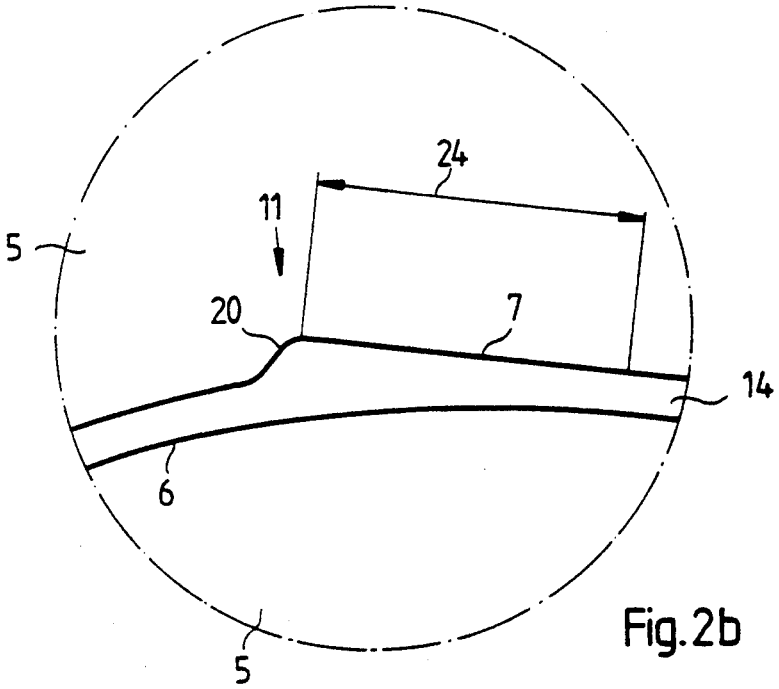
Figure 3:
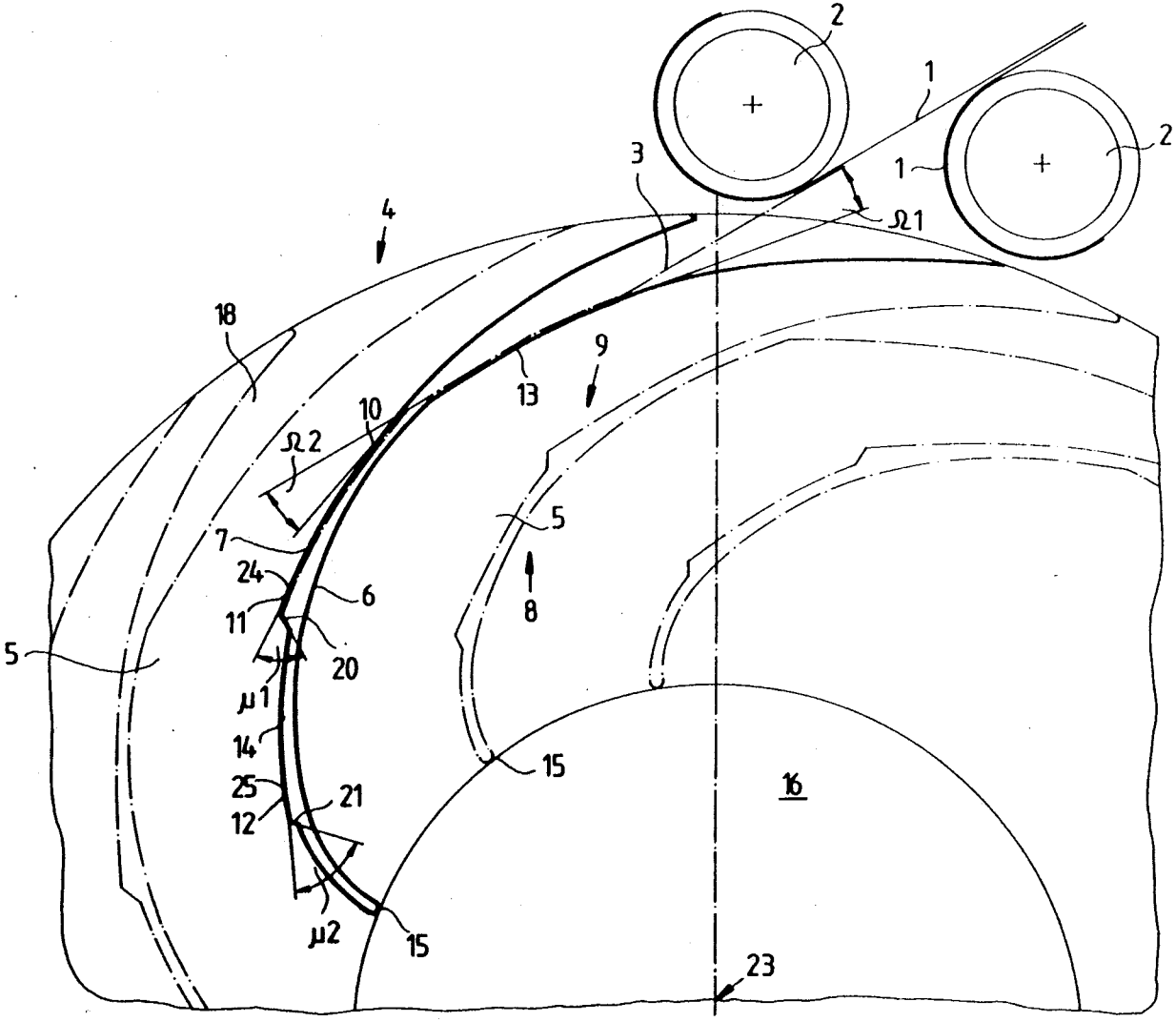
Figure 4A:
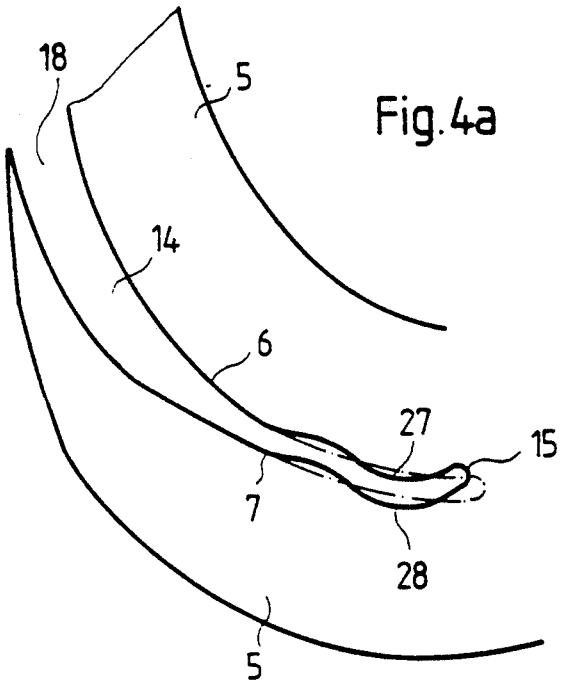
Figure 4B:
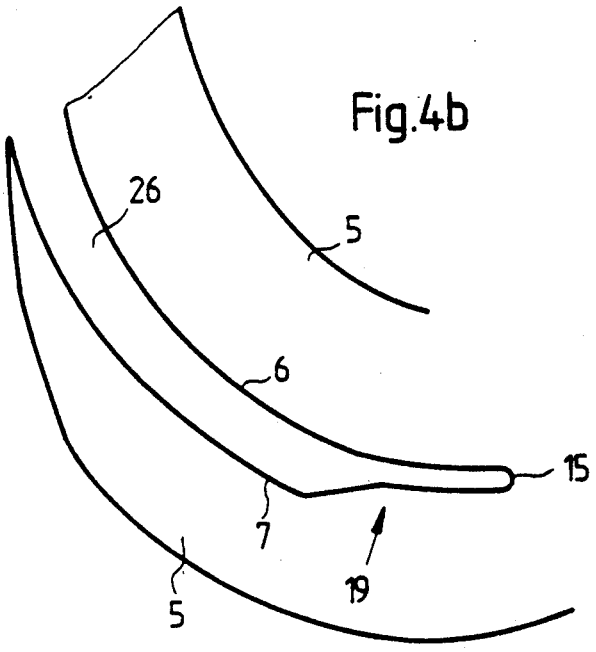

FIGS. 1*a* and 1*b* are respective diagrammatic, side-elevational and front-elevational views of a fan wheel according to the invention;

FIGS. 2*a* and 2*b* are side-elevational views showing details of profiles of trailing edges of fan blades;

FIG. 3 is an enlarged, fragmentary, side-elevational view of a fan pocket showing details of the profiles; and FIGS. 4*a* and 4*b* are fragmentary, side-elevational views showing structural variations for fan pocket-profiles.

Referring now to the FIGURES of the drawing in detail and first, particularly, to FIGS. 1*a* and 1*b* thereof, there is seen a fan wheel 4, which is formed of heavily or greatly bent fan blades 5. The fan blades 5 are delimited by leading edges 6 and trailing edges 7. The leading edge 6 is furnished with a first profile 8, whereas the trailing edge 7 of a fan blade 5 is furnished with a second profile 9. In the illustrated construction, each fan blade 5 is furnished with the profiles 8 and 9. It is, however, also possible to place the fan blades 5 alternatingly around a fan wheel hub. In that case, a fan blade 5 which is profiled on both sides is followed by a fan blade 5 without profiled leading and trailing edges, and finally a fan blade 5 which is profiled on both sides is again provided, and so on. Another conceivable construction in the above sense would be to provide alternating fan blades 5, each having only one of the edges furnished with a profile. However, the configuration shown in FIG. 1 is preferably used.

The heavy or severe bending of the leading edge 6 in the outer region of the fan blades 5, in comparison to the trailing edge 7 of the preceding fan blade 5, permits the formation of a wedge-shaped input region 18. This insures that folded products or books 3, which are being transported with their open ends into the fan wheel 4 as seen in FIG. 3, also arrive safe and secure for a slow down process. The fan blades 5 have tooling holes 22 formed therein. Each of the fan wheel pockets 14 for an incoming folded product 3 is defined by a trailing or back-positioned fan blade 5 having the leading edge 6 in reference to the incoming folded product 3, and a leading or front-positioned fan blade 5 having the trailing edge 7 in reference to the incoming folded product 3.

Fan wheel pockets 14, which are formed by the fan blades 5, are more heavily bent in the direction of a fan wheel hub 16 in an interior region. This allows a controlled deformation or modelling of the folded products 3, which results in a lowering of the kinetic energy of the folded products 3. The fan wheel hub 16 has a center 23.

The illustration of the fan wheel hub 16 in the front view of FIG. 1*b* shows a possibility of fastening the fan wheel 4 onto a carrier shaft.

FIGS. 2*a* and 2*b* illustrate details of the profiles of trailing edges 7 of the fan blades 5. FIG. 2*b* shows a first concave recess 11 at the trailing edge 7 of a fan blade 5. The trailing edge 7, following a delay path or distance 10 shown in FIG. 3, is furnished with an input section 24. Following the input section 24 is an output section 20. The fan wheel pocket 14 is defined by the leading edge 6 and the trailing edge 7.

FIG. 2*a* shows a concave recess 12 in detail. This recess is also positioned at the trailing edge 7 of a fan blade 5, but it is further down in the fan wheel pocket 14, as seen by the circles shown in phantom in FIG. 1*a*. Furthermore, the concave recess 12 has an input section 25 as well as an output section 21, in order to slow down the folded products 3.

FIG. 3 shows an enlarged portion of a fan wheel including details regarding edge-profiling. Transport tapes 1 running over transport tape rolls 2 lead the folded products 3 into the input region 18. In the illustrated example of the structure, the input region 18 has a wedge-shaped or tapered construction. The leading end of the folded product 3 and a tangential impact path or distance 13 therefore include an angle $\Omega_1$. This angle $\Omega_1$ preferably lies between 15° and 20°. The folded product 3 traverses a first slow down step alongside the impact path 13. After traversing the impact path 13, the leading end of the folded product 3 arrives under an angle $\Omega_2$ at the delay path 10, which is executed at the trailing edge 7 of the preceding fan blade 5. The angle $\Omega_2$ preferably lies in a region between 20° and 25°, although other angles would be conceivable as well.

Alongside the delay path 10, the folded product 3 is subjected to a second slow down step. During the first two slow down steps through the impact path 13 and the delay path 10, besides experiencing a slow down due to friction, the folded products are impressed or embossed with a controlled deformation through which the kinetic energy of the folded products 3 is additionally lowered. It is therefore of the greatest importance that the total length of the folded product 3 is being deformed or modelled while moving past the impact path 13 and the delay path 10, and that steps are being taken to make changes in the moving direction. This makes the entire length of the folded product 3 available as a usable slow down or brake surface, not just the leading end of the folded product 3. In addition, all of the parts of the folded product 3 are being used for deformation or modelling and therefore also for decreasing or lowering the kinetic energy. In this way, the mechanical stress or wear and tear of the folded products 3 is evenly distributed and damage to the sensitive forwardly extending or leading end of the folded product 3 is avoided.

After moving past the delay path 10 of the trailing edge 7, the leading end of the folded product 3 arrives at the input section 24 of the concave recess 11 in the trailing edge 7. After having reached the concave recess 11, the folded product 3 has completely entered into the fan pocket 14. This prevents the tail of the folded product 3 from whipping around the entrance tip of the fan blade 5.

Due to the input of the leading end of the folded product 3, the folded product 3 experiences a third slow down or brake step and after the delay through a nose shaped depression as shown in this embodiment example, and after moving past the output or delivery section 20, a further bending of the fan wheel pockets 14 again follows. An angle between an imaginary extension of the input section 24 and the output section 20, which is identified with reference symbol $\mu_1$, preferably reaches 55°, although it can also assume a lower value. After this third slow down step, the leading end of the folded product 3 arrives at the further concave recess 12.

The leading end of the folded product 3 is again delayed through the use of this nose-shaped depression provided in the lower region of the fan wheel pocket 14. Enclosed between an imaginary extension of the input section 25 and the output or delivery section 21 is an angle $\mu_2$, which preferably is 70°, but can also have other values. The heavily or severely bent region of the fan wheel pocket 14, which follows behind the concave recess 12, extends to the bottom 15 of the pocket, onto which the delayed folded product 3 finally impacts.

As compared to the two first-mentioned slow down steps at the impact path 13 and the delay path 10, a targeted slow down of the leading end of the folded product 3, which has already passed through two slow down steps, occurs at the third and fourth slow down steps. Since the leading end of the folded product 3 has passed the concave recesses 11 and 12, the remaining part of the folded product 3 is impressed or alongside these recesses 1 and Kinetic energy is further decreased thereby. Through the use of the trailing edge 7, having the profile 9 being formed of delay path 10 and the concave recesses 11 and 12, as well as the profile 8 being formed of the impact path 13 and the severely bent leading edge 6, a targeted delay of the individual folded products 3 is obtained. In this way, with constant speed, a stripping of the folded products 3 is possible. The length of the fan wheel pockets 14 can exceed the length of the folded products 3, which are to be slowed down. Through the use of this feature, a long slow down path is made available. The length of the fan wheel pocket 14 should be laid out in such a way that the step-wise slowed down folded product 3 reaches the bottom 15 of the pocket, thereby experiencing a further slowdown. The folded product 3 is then already delayed to such an extent that damage to the edges of the folded products 3 is impossible. Reaching the bottom 15 of the pocket ensures that the folded products 3, which have been accepted by a stripper, can be laid out evenly in a shingled formation.

The above-described slow down procedure for folded products which is accomplished by profiling fan blade edges, therefore includes slowing down an extensive or large surface through friction as the first slow down steps. Parallel thereto, deformities are impressed or embossed onto the folded products 3, which reduce or lower the kinetic energy of the folded products that are moving at high speed. At the third and fourth slow down steps there are additional impressed or embossed deformities that absorb kinetic energy in their own right and also heighten frictional slow down as the impressed or embossed areas are pressed with greater normal force into the leading and trailing edges. Then, the folded products finally arrive at the bottom 15 of the pocket. By modifying the basic concept of the invention, it would also be conceivable to profile the edges of the fan blades 5 in wave-form, in order to achieve a decrease of kinetic energy of the folded products 3 only, based on the impressed or embossed deformation. On the other hand, it is also possible to form fan wheels in such a way that there are several convex or concave depressions or recesses at the trailing edge 7 and impact paths 13 and/or delay paths 10 are not provided. However, the best result is achieved through a combination of slowing down an extensive or large surface through friction, through controlled deformation of the folded products for reducing or lowering the kinetic energy, as well as through the targeted delay of the leading end of the folded product 3 and stripping after the bottom 15 of the pocket has been reached. The leading edge 6 in the vicinity of said impact path 13 and the trailing edge 7 in the vicinity of the delay path 10 of the first concave recess 11 and said second concave recess 12 may be formed of ink-repellent material.

FIGS. 4*a* and 4*b* show structural possibilities for fan blade edge-profiles.

FIG. 4*a* shows a fan wheel pocket 14, which has a pocket region that is situated close to the fan wheel hub and is bent meander-like several times. The leading edge 6 and the trailing edge 7 of the fan blades 5 following the input region 18 thereby provide a profile which has been bent several times and can be formed of respective convex projections 27 and concave depressions 28.

FIG. 4*b* illustrates another pocket configuration. In this configuration an input region 26 is maintained substantially longer and wider than that which is shown in the embodiment example of FIG. 4*a*.

The trailing edge 7 is provided with a discontinuous, unsteady or changeable contour 19, with the help of which the folded products 3 are slowed down before they hit the bottom of the pocket. The trailing edge 7 of a fan blade 5 can be provided with a multiplicity of such contours 19.

What is claimed is:

1. A delivery device in a folding apparatus of a printing press, comprising:

at least one fan wheel, said fan wheel, said fan wheel being formed of individual fan blades having respective edges defining fan wheel pockets between respective leading and trailing fan blades for receiving incoming folded products, the respective edge of each of said trailing fan blades partly defining each of said pockets being a leading edge relative to the incoming folded product and being formed with a first profile having at least one folded-product slow-down path, and the respective edge of each of said leading fan blades partly defining each of said pockets being a trailing edge relative to the incoming folded product and being formed with a second profile having a plurality of slow-down paths different from said one slow-down path of said first profile.

2. The delivery device according to claim 1, wherein each of said first profiles of said fan blades at said leading edges have an impact path, and said fan wheel pockets are formed by said leading edge and said trailing edge being bent to form a bottom region of said pocket.

3. The delivery device according to claim 1, wherein said fan wheel pockets are bent several times into a meander-like shape.

4. The delivery device according to claim 1, wherein said fan wheel pockets have an input region and a narrowing formed by a discontinuously running contour of said trailing edge.

5. The delivery device according to claim 1, wherein said first profiles of said fan blades at said leading edges have an impact path, and a folded product entering into said fan wheel pocket forms a given angle with said impact path.

6. The delivery device according to claim 1, wherein said first profiles of said fan blades at said leading edges have an impact path with an end, and a folded product leaving the impact path forms a given angle with the end of said impact path.

7. The delivery device according to claim 1, wherein said fan wheel pockets are longer than the folded products.

8. The delivery device according to claim 1, wherein the entire length of a folded product enters said fan pocket.

9. A delivery device in a folding apparatus of a printing press, comprising:

at least one fan wheel, said fan wheel being formed of individual fan blades having respective edges defining fan wheel pockets between respective leading and trailing said fan blades for receiving incoming folded products, the respective edge of each of said training fan blades partly defining each of said pockets being a leading edge relative to the incoming folded product and being formed with a first profile, and the respective edge of each of said a leading fan blades partly defining each of said pockets being a trailing edge relative to the incoming folded product, and being formed with a second profile, each of said second profiles of said fan blades at said trailing edges having a delay path, a first concave recess and a second concave recess.

10. The delivery device according to claim 9, wherein said first concave recess has a delivery section forming a given angle with a leading end of a folded product.

11. The delivery device according to claim 9, wherein said second concave recess has a delivery section forming a given angle with a leading end of a folded product.

12. A delivery device in a folding apparatus of a printing press, comprising:

at least one fan wheel, said fan wheel being formed of individual fan blades having respective edges defining fan wheel pockets between respective leading and trailing said fan blades for receiving incoming folded products, the respective edge of each of said trailing fan blades partly defining each of said pockets being a leading edge relative to the incoming folded product and being formed with a first profile, and the respective edge of each of said a leading fan blades partly defining each of said pockets being a trailing edge relative to the incoming folded product, and being formed with a second profile, each of said second profiles of said fan blades at said trailing edges having a delay path, a first concave recess and a second concave recess, each of said first profiles of said fan blades at said leading edges having an impact path, and said leading edge in the vicinity of said impact path and said trailing edge in the vicinity of said delay path of said first concave recess and said second concave recess being formed of ink-repellent material.

* * * * *